United States Patent [19]

Girsch et al.

[11] Patent Number: 4,718,877

[45] Date of Patent: Jan. 12, 1988

[54] WINGED TOY

[76] Inventors: Charles W. Girsch; B. J. Maria Girsch, both of 294 Summit Ave., St. Paul, Minn. 55102

[21] Appl. No.: 909,916

[22] Filed: Sep. 22, 1986

[51] Int. Cl.[4] ..... A63H 3/00; A63H 3/06; A63H 3/20

[52] U.S. Cl. ..... 446/313; 446/183; 446/330; 446/365

[58] Field of Search ..... 446/313, 330, 268, 183, 446/365, 359, 340

[56] References Cited

U.S. PATENT DOCUMENTS

| | | | |
|---|---|---|---|
| 2,614,365 | 10/1952 | Musselwhite et al. | 446/330 |
| 2,637,939 | 5/1953 | Polk | 446/365 X |
| 2,960,794 | 11/1960 | Johns | 446/183 |
| 4,244,138 | 1/1981 | Holahan et al. | 446/365 X |
| 4,575,349 | 3/1986 | Piazza et al. | 446/330 |

FOREIGN PATENT DOCUMENTS

| | | | |
|---|---|---|---|
| 1112903 | 3/1956 | France | 446/313 |
| 2171323 | 8/1986 | United Kingdom | 446/330 |

*Primary Examiner*—Philip C. Kannan
*Attorney, Agent, or Firm*—Kinney & Lange

[57] ABSTRACT

A winged toy having a flexible hollow body resembling that of a butterfly. Wings are secured to the hollow body portion and upon the hollow body portion being distorted, as by squeezing, the angular position of the wings is changed. Thus, by squeezing and releasing the hollow body repeatedly, the wings can be made to move up and down to simulate a flapping motion.

A toy figure such as a fairy is seated upon a saddle member having a backrest, a base portion and a stud, the legs of the toy figure straddling the stud. The body portion is provided at its forward end with antennae which are held by the hands of the fairy to provide further support for the fairy.

20 Claims, 7 Drawing Figures

WINGED TOY

BACKGROUND OF THE INVENTION

1. Field of the Invention

The present invention pertains to a winged toy in which provision is made for manually moving the wings up and down to simulate flapping of the wings.

SUMMARY OF THE INVENTION

The present invention is concerned with a winged toy in which there is a flexible hollow body portion supporting oppositely disposed wings secured to the body portion in such a manner that distortion of the body portion, as by squeezing, causes the angular position of the wings to change. By squeezing and releasing the body portion, the wings are caused to simulate a flapping motion. Specifically, the invention is concerned with a device in which the body portion simulates the body portion of a winged animal, more particularly a butterfly.

A further feature of the invention is that a saddle is secured to the body portion for supporting a toy rider.

The body portion and wings are designed to simulate the body and wings of a butterfly. One suitable form of rider is that of a figure resembling a fairy. The saddle preferably has a receptacle for supporting a toy wand and has a post designed to extend between the legs of the toy rider.

Other features of the invention will be apparent from the accompanying description, claims and drawing.

DETAILED DESCRIPTION OF THE PREFERRED EMBODIMENTS

Figures 1, 2, 4:
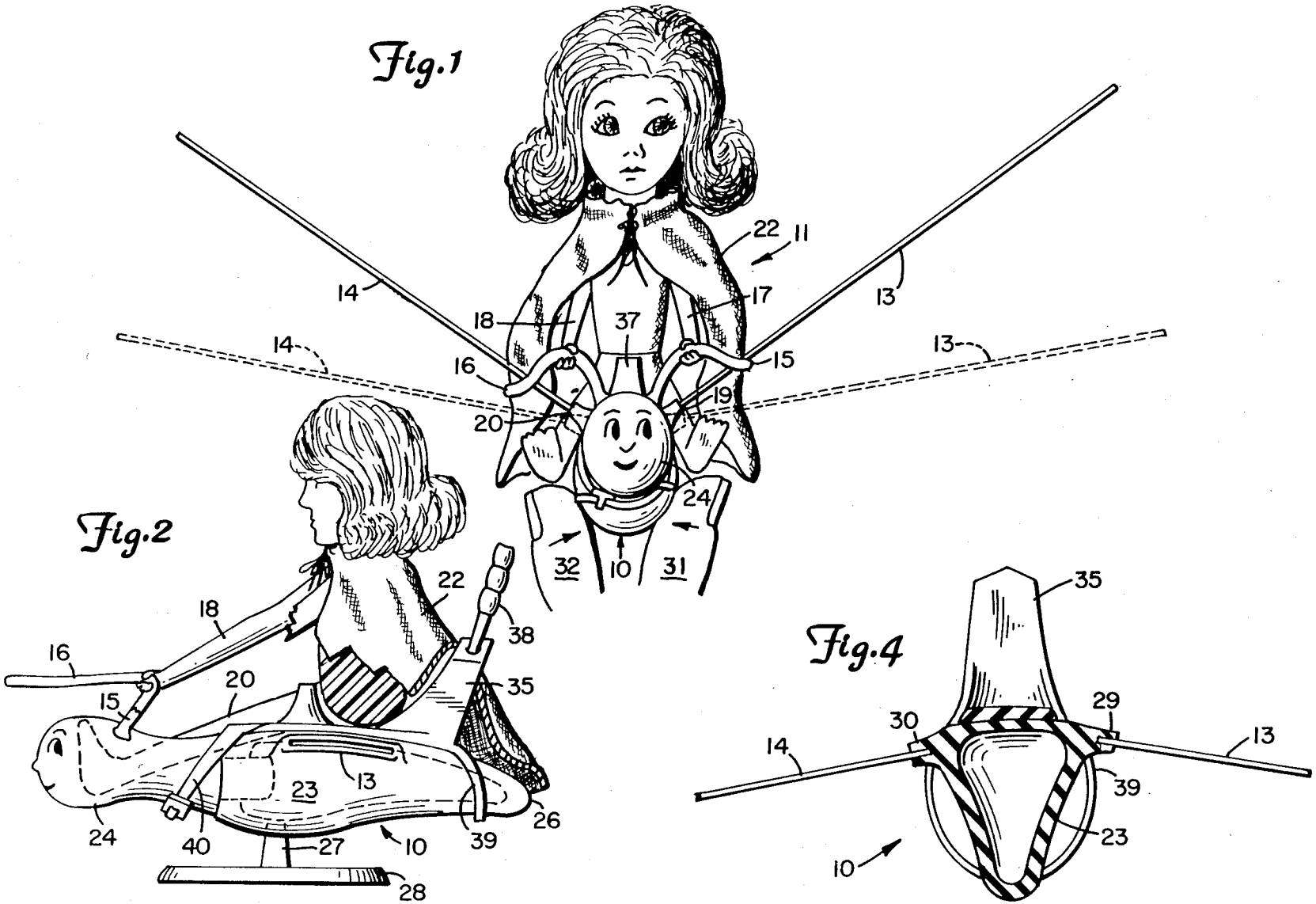
FIG. 1 is a front elevational view showing the improved winged toy, the wings being shown in one position in solid lines and in a different position in dotted lines.
FIG. 2 is a side elevational view of the winged toy with portions being cut away and portions shown in section, the winged toy being shown as supported on a pedestal support member.
FIG. 4 is a sectional view taken along the line 4—4 of FIG. 3 and showing the body portion distorted to change the angle of the wings.
Figure 3:
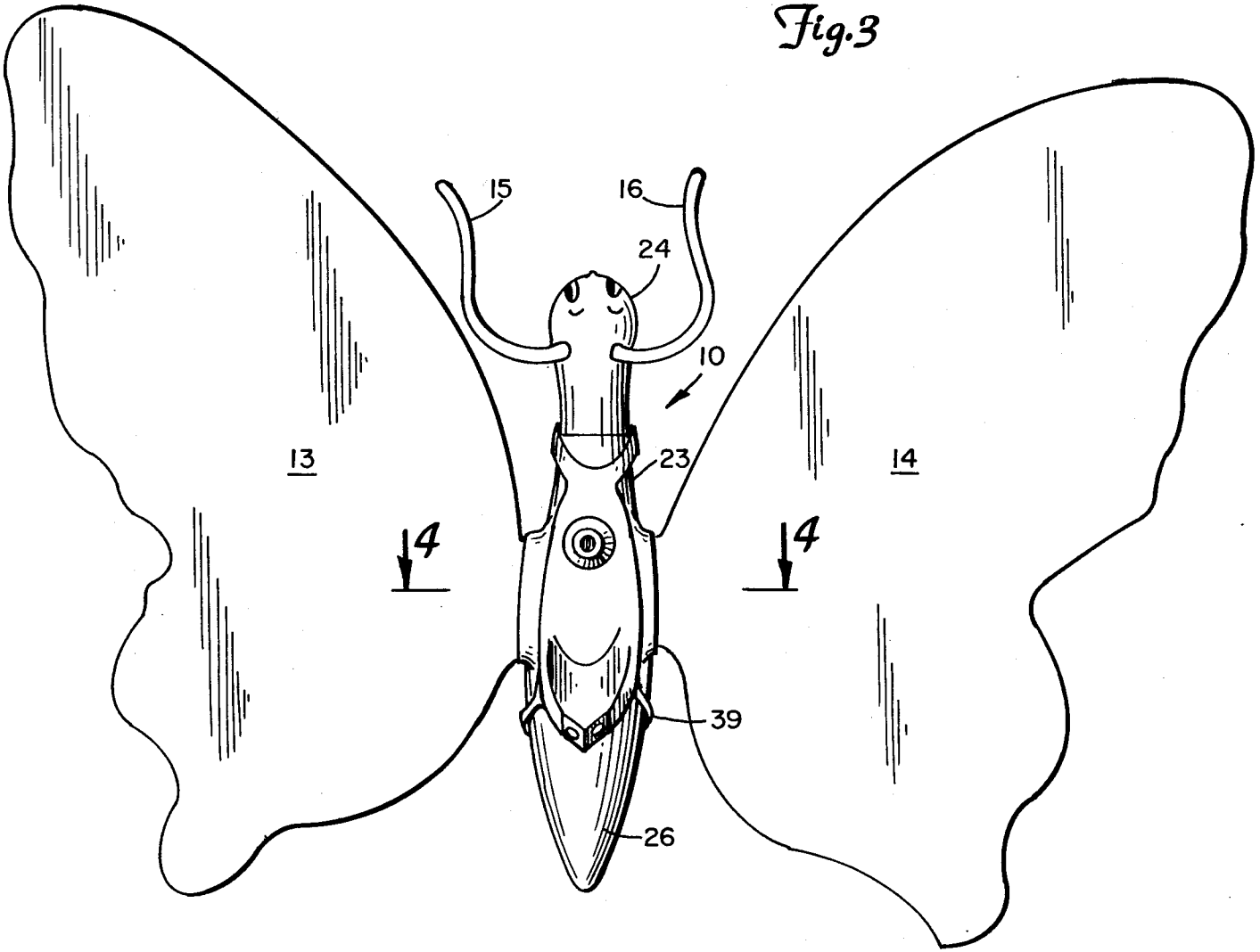
FIG. 3 is a top plan view of the winged toy without the rider.

Referring to FIG. 1, the device consists broadly of an animal body portion 10 and a rider 11 which specifically takes the form of a fairy. Secured to the body portion, in a manner to be described in more detail later, are two wings 13 and 14. The animal simulates a butterfly, and the wings 13 and 14 shown in plan view in FIG. 3 are shaped to generally conform wih the wings of a typical butterfly. The body portion 10 is provided with two antennas 15 and 16 intended to resemble the antennas of a butterfly. A doll is provided with two arms 17 and 18, which are designed to grip the antennas 15 and 16 respectively, as best shown in FIGS. 1 and 2. The doll is also provided with legs 19 and 20 which are designed to straddle the body 10 of the butterfly. The doll is also provided with a cape 22 resembling the cape which fairies are customarily depicted as wearing.

Figure 5:
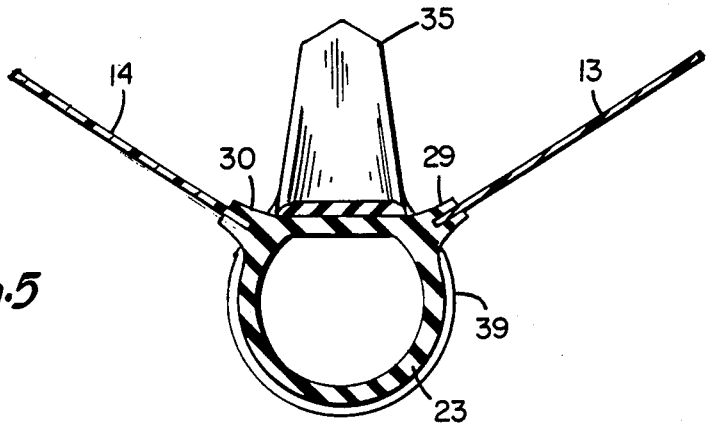
FIG. 5 is a view similar to FIG. 4 but with the body portion and the wings in their normal positions.

The body portion 10 of the butterfly has a center body portion 23, a head portion 24 and a tail portion 26. As best shown in FIGS. 4 and 5, the body portion is hollow and is preferably formed of a flexible material such as rubber. The body portion is formed with a recess designed to fit over a stud 27 projecting from a base member 28. When the winged toy is not being manipulated, it can be forced over the stud 27 so as to be held in a stable position on any suitable supporting surface such as a table or shelf.

Referring to FIGS. 4 and 5, the body portion 23 is provided at its upper extremity with two projecting ribs 29 and 30 which are slotted to receive the wings 13 and 14. The wings 13 and 14 are secured in the slots in the ribs 29 and 30 by suitable means such as an adhesive which retains the wings 13 and 14 securely fixed in the ribs 29 and 30. It will be noted from FIG. 5 that the ribs 29 and 30 extend angularly upwardly so that the wings 13 and 14 normally also extend angularly upwardly.

Referring now to FIG. 4, it will be noted that if the opposite side walls of the central body portion 23 are squeezed, the angular positions of ribs 29 and 30 are changed. In other words, these are changed so that they tend to angularly point downwardly. This causes the wings 13 and 14 to also point downwardly.

The squeezing of the body portion can be accomplished in various ways. One suitable way of doing this is to squeeze the body portion between the thumb 31 and forefinger 32, as shown in FIG. 1. Squeezing of the body portion in this manner causes the members to assume the position shown in FIG. 4. It will be obvious from the above that if the body portion is alternately squeezed and released, the angular positions of the wings will change back and forth so as to cause a flapping motion of the wings.

Figure 6:
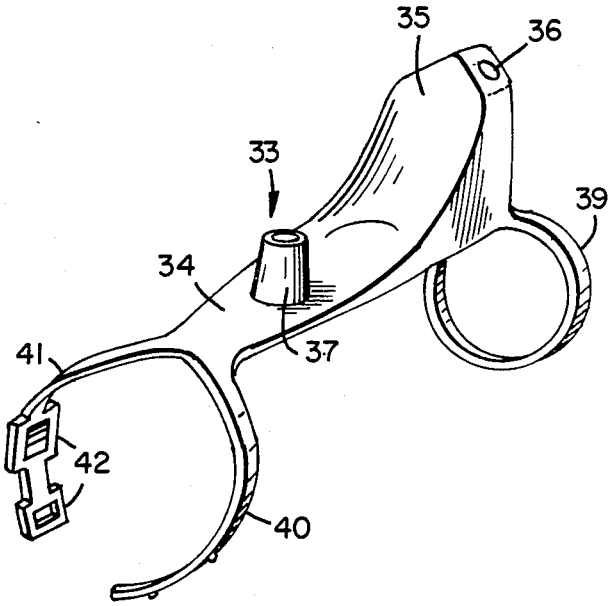
FIG. 6 is a perspective view of a saddle member designed to be secured to the body portion of the winged member.
Figure 7:
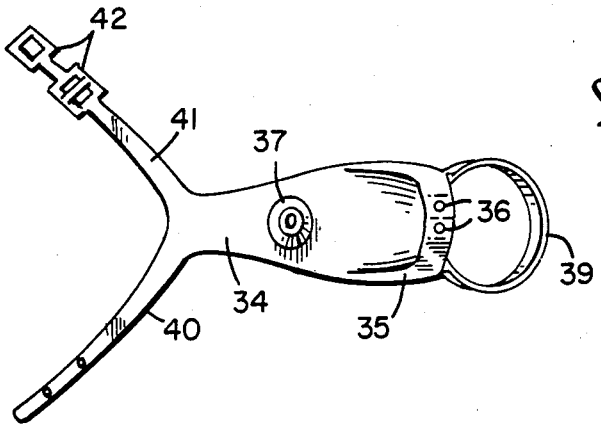
FIG. 7 is a top plan view of the saddle member.

As previously indicated, the fairy 11 is supported on a saddle member 33. This saddle member is best shown in FIGS. 6 and 7. Referring to these figures, the saddle member comprises a base or seat portion 34 on which the doll sits. There is also a backrest 35 which contains several openings 36 for the reception of one or more wands. A wand 38 (only a portion of which is shown) is shown in FIG. 2 as being disposed in such an opening.

The flat portion 34 of the saddle has an upstanding post 37. This is designed to give added support to the legs 19 and 20 of the doll. As shown in FIGS. 1 and 2, the legs straddle this post or stud 37.

At the rear of the saddle member there is a loop 39 which is designed to go over the rear portion 26 of the body portion 10. At the front of the saddle portion, there are two strap members 40 and 41, and a buckle member 42. After the loop 39 of the saddle member is slid over the rear of the body portion 10, the straps 40 and 41 can then be wrapped around the forward portion of the body portion 10 and the ends fastened together by the buckle member 42. The saddle member is thus held firmly on the body 10. The saddle 33 enables the fairy 11 to be adequately supported on the body portion 10. This is accomplished by the hands gripping the antennas 15 and 16, the legs straddling the post or stud 37 and the back leaning against the back support 35. The wand 38 is inserted into one of the openings 36 and simulates the magic wand which every fairy is supposed to carry.

In use, the device is held between the thumb and forefinger, as shown in FIG. 1, and squeezed back and forth. At the same time, the hand can move the toy in a forward direction so as to simulate forward movement of the toy as the wings 13 and 14 flap. The result is a very attractive toy which simulates the flight of a butterfly with a fairy riding on its back.

While we have described a specific embodiment for purposes of illustration, it is to be understood that the invention is limited solely by the appended claims.

What is claimed is:

1. A winged toy having a flexible, hollow body portion designed to be held in a hand of an operator;

a plurality of wings designed to be secured to and projecting from opposite sides of the body portion; and means for securing said wings to opposite walls of said body portion in such a manner that said wings normally project from the body portions at a predetermined angle with respect to a horizontal plane through the body portion, said predetermined angle being changed upon squeezing of said body portion due to distortion of the body wall changing the angle at which the securing means hold the wings, thus causing the wings to give the appearance of flapping.

2. The toy of claim 1 in which the body portion simulates the body portion of a winged animal.

3. The toy of claim 1 in which the body portion simulates the body of a butterfly.

4. The toy of claim 1 in which the body portion is designed to be held between the thumb and forefinger of the operator to facilitate squeezing of the body portion.

5. The toy of claim 1 in which a saddle is secured to the body portion for supporting a toy rider.

6. The toy of claim 5 in which the saddle has a post designed to extend between the legs of the toy rider.

7. The toy of claim 5 in which the body portion and wings simulate the body and wings of a butterfly, and in which a figure resembling a fairy is supported by the saddle.

8. The toy of claim 7 in which the saddle has a receptacle for supporting a toy wand.

9. A winged toy having:

a flexible hollow body portion designed to be held between the thumb and forefinger of an operator to facilitate squeezing of the body portion;

a plurality of wings designed to be secured to and projecting from opposite sides of the body portion; and means for securing said wings to opposite walls of said body portion in such a manner that said wings normally project from the body portions at a predetermined angle with respect to a horizontal plane through the body portion, said predetermined angle being changed upon squeezing of said body portion due to distortion of the body wall changing the angle at which the securing means holds the wings.

10. The toy of claim 9 in which the body portion simulates the body portion of a winged animal.

11. The toy of claim 9 in which the body portion simulates the body of a butterfly.

12. The toy of claim 9 in which a saddle is secured to the body portion for supporting a toy rider.

13. The toy of claim 12 in which the saddle has a post designed to extend between the legs of the toy rider.

14. The toy of claim 12 in which the body portion and wing simulate the body and wings of a butterfly, and in which a figure resembling a fairy supported by the saddle.

15. The toy of claim 14 in which the saddle has a receptacle for supporting a toy wand.

16. A winged toy having a flexible hollow body portion designed to be held in the hand of an operator;

a plurality of wings designed to be secured to and projecting from opposite sides of the body portion wherein the body portion and wings simulate the body and wings of a butterfly;

a saddle secured to the body portion for supporting a toy rider; and means for securing said wings to opposite walls of said body portion in such a manner that said wings normally project from the body portions at a predetermined angle with respect to a horizontal plane through the body portion, said predetermined angle being changed upon squeezing of said body portion due to distortion of the body wall changing the angle at which the securing means holds the wings.

17. The toy of claim 16 in which the body portion is designed to be held between the thumb and forefinger of the operator to facilitate squeezing of the body portion.

18. The toy of claim 16 in which the saddle has a receptacle for supporting a toy wand.

19. The toy of claim 16 in which the toy rider is a figure resembling a fairy.

20. The toy of claim 16 in which the saddle has a post designed to extend between the legs of the toy rider.

* * * * *